US006918399B2

(12) United States Patent
Ko

(10) Patent No.: US 6,918,399 B2
(45) Date of Patent: Jul. 19, 2005

(54) AUTOMATIC UMBRELLA

(76) Inventor: Chin Sung Ko, No. 38, Din Nan Road, Ho Mei, Changhua Shien (TW)

( * ) Notice: Subject to any disclaimer, the term of this patent is extended or adjusted under 35 U.S.C. 154(b) by 152 days.

(21) Appl. No.: 10/437,300

(22) Filed: May 14, 2003

(65) Prior Publication Data

US 2004/0226590 A1 Nov. 18, 2004

(51) Int. Cl.[7] ..... A45B 25/06
(52) U.S. Cl. ..... 135/29; 135/28; 135/27; 135/31
(58) Field of Search ..... 135/22–23, 27–31, 135/15

(56) References Cited

U.S. PATENT DOCUMENTS 2,321,495 A * 6/1943 Levin ..... 135/28
5,263,505 A * 11/1993 Yeom ..... 135/20.1
5,355,903 A * 10/1994 Haddad et al. ..... 135/20.1
5,884,645 A * 3/1999 Chen et al. ..... 135/25.1
6,397,866 B1 * 6/2002 You ..... 135/23
6,595,225 B2 * 7/2003 Chuang et al. ..... 135/31
6,722,382 B2 * 4/2004 Wang ..... 135/30
6,789,556 B2 * 9/2004 You ..... 135/31

FOREIGN PATENT DOCUMENTS

JP 11-276225 * 10/1999

* cited by examiner

*Primary Examiner*—Winnie Yip
(74) *Attorney, Agent, or Firm*—Rosenberg, Klein & Lee

(57) ABSTRACT

The present invention relates to an automatic umbrella, which mainly uses an elastic frame to receive the second rib of the umbrella. The elastic frame can be connected with the runner easily. In opening procedure, the elastic branch rib of the elastic frame can be bended and inclined to push the second rib upward. At the time, the umbrella is opened automatically. The assembled elastic frame and the rib can be easily and firmly that provides improvement for use of the automatic umbrella.

4 Claims, 8 Drawing Sheets

AUTOMATIC UMBRELLA

BACKGROUND OF THE INVENTION

The present invention refers to an automatic umbrella, which can be assembled easily and decreased the weight for utility.

As shown in FIG. 1, a conventional automatic umbrella includes a shaft (1) having an upper joint (11). A runner (2) is provided around the shaft (1). The frame of the umbrella has its inner end connecting with the upper joint (11) and middle joint (21) on the runner (2) respectively. A coil spring (23) in the runner (2) provides elastic force for opening the umbrella. This conventional umbrella has the branch rib (33) to connect with the runner (2) by use of a metal wire (5), which winds the inner end of the branch rib (33) together with lower joint (22) on the runner (2). This manufacturing procedure is very trouble and wastes of time. Moreover, the branch rib and the second rib of the prior umbrella are made of metal material. So the weight is somehow too heavy for carrying.

In order to solve this drawback, the present invention mainly provides an improved automatic umbrella, which includes a plastic elastic frame to be assembled with the runner easily. The second rib of the umbrella can be engaged with the elastic frame easily and can be made of plastic also while the weight of the umbrella is decreased.

BRIEF DESCRIPTION OF THE DRAWINGS

The following drawings indicate the character and improvement of the apparatus of the present invention.

DETAILED DESCRIPTION OF THE INVENTION

Figure 1:
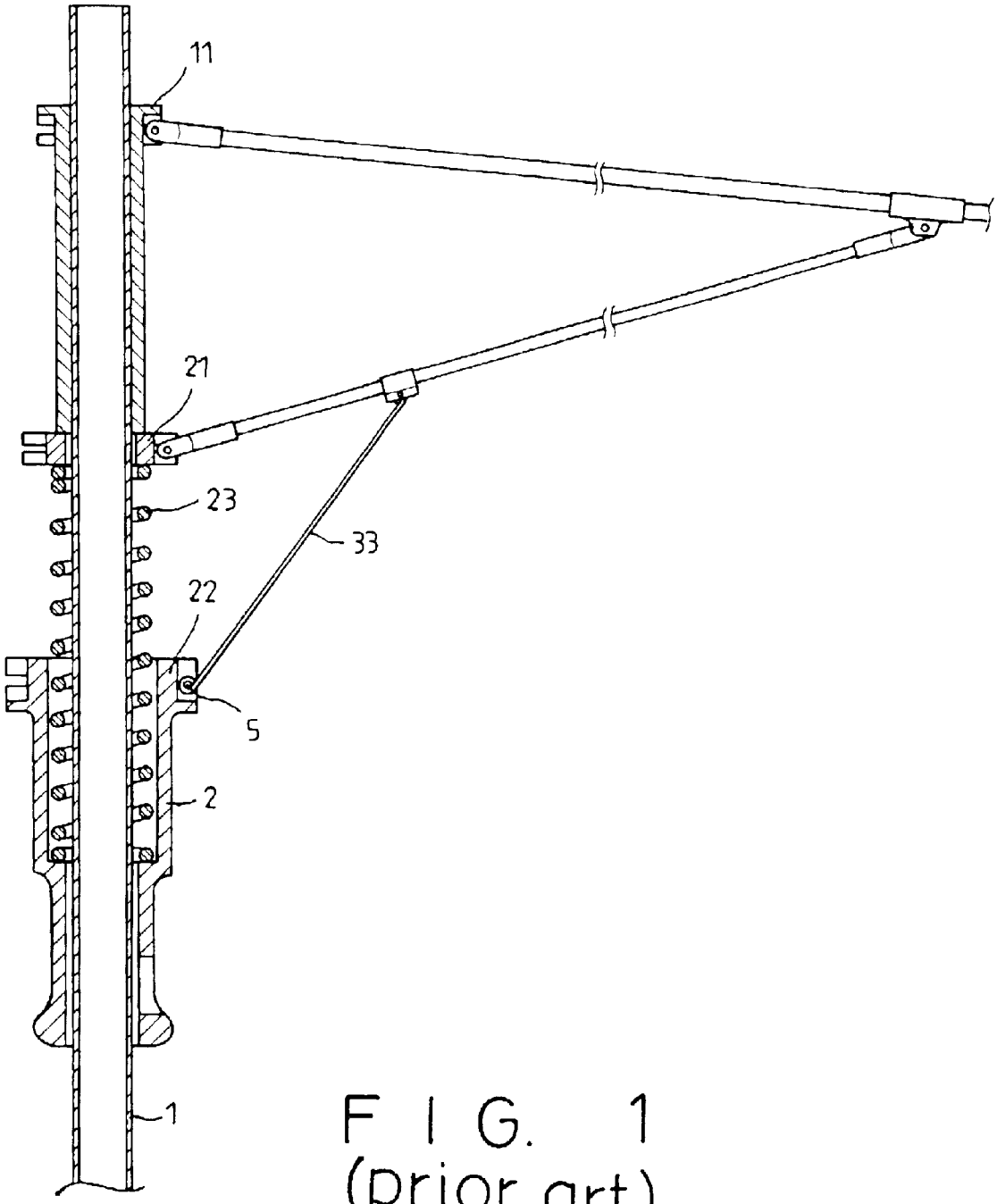
FIG. 1 (prior art)
FIG. 1 is a cross-sectional plan view showing a conventional automatic umbrella in opening state.
Figure 2:
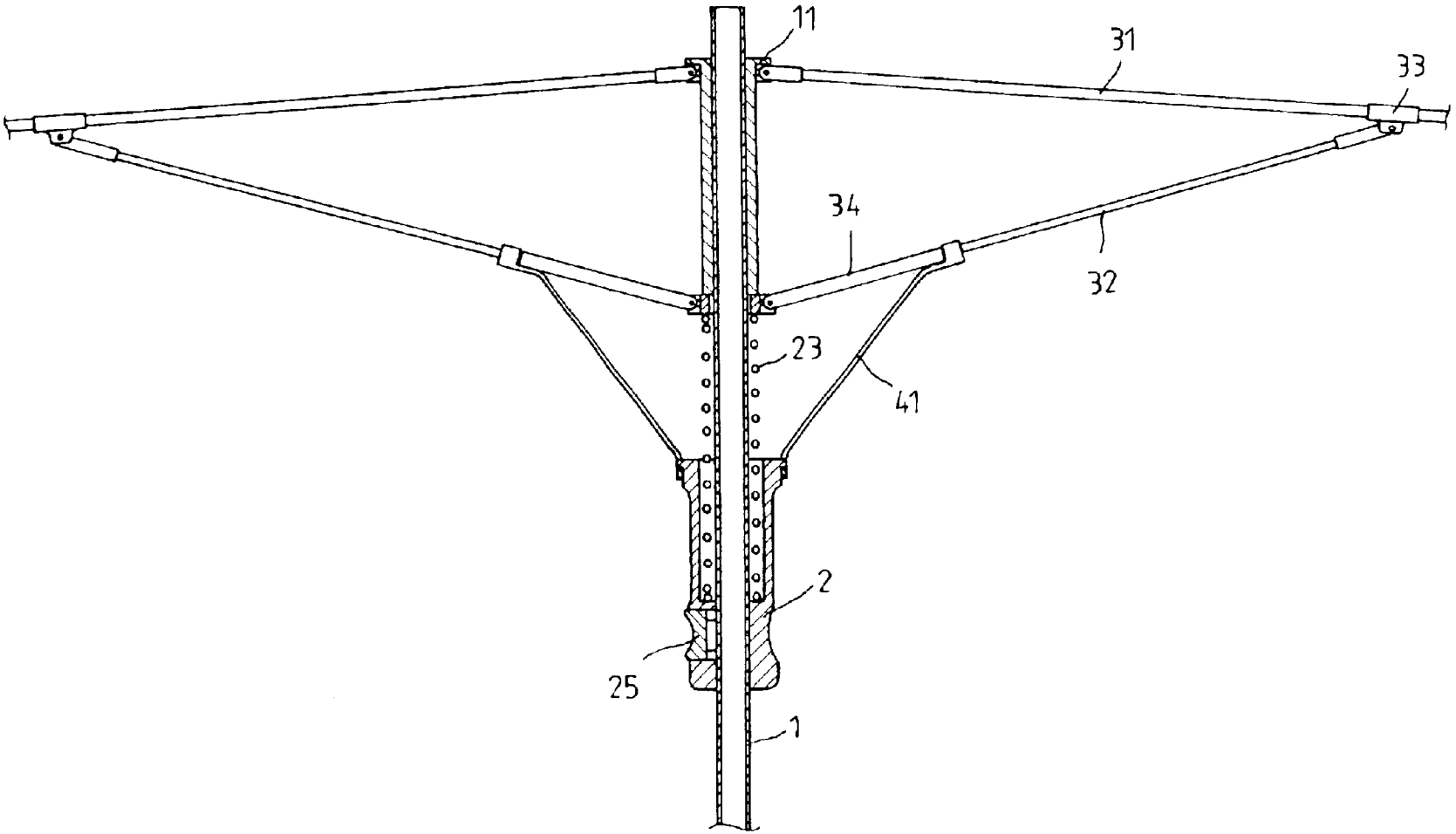
FIG. 2 is a cross-sectional plan view showing an automatic umbrella in opening state according to the present invention.

Referring to FIG. 2 to 5, the present invention relates to an improvement of the automatic umbrella, which includes a shaft (1) and a runner (2) connecting with a frame having the main rib (31) and the second rib (32). The inner end of the main rib (31) is connected with an upper joint (11) on the shaft (1). A U-shape spring (12) is received in the shaft (1) and a handle (13) is connected with lower end of the shaft (1).

The characteristic of the present invention is to provide a plastic elastic frame (4), which includes a ring-base (40) and several parallel elastic branch ribs (41) while several gaps (42) are formed in a same interval. Each elastic branch rib (41) is provided with a hole (43) at top end.

Figure 11:
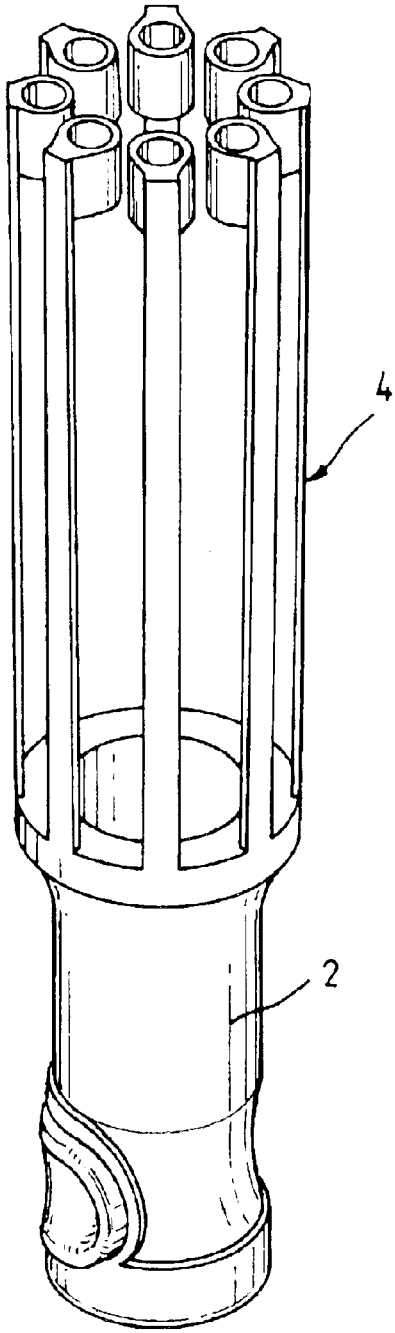
FIG. 11 is a perspective view showing a one-piece structure including the runner and the elastic frame according to the present invention.

The runner (2) provided with inner coil spring (23) has several engaging projections (24) in interval at top end. While connecting the runner (2) and the elastic frame (4), each engaging projection (24) will be engaged with a related gap (42) between two adjacent elastic ribs (41). Hence, the runner (2) and the elastic frame (4) becomes a single body firmly. It can be understood that the runner (2) and the elastic frame (4) can be also manufactured to be a single piece as shown in FIG. 11.

The second rib (32) being capable of being received in the hole (43) of the elastic rib (41) has its outer end pivoting with a connector (33) to connect with the main rib (31) and has its inner end connecting with a tube (34) having its diameter larger than the hole (43) of the elastic rib (41) for preventing from being released. The second rib (32) can be made of plastic material. A button (25) having two engaging slices (251) is provided at lower side of the runner (2).

Figure 3:
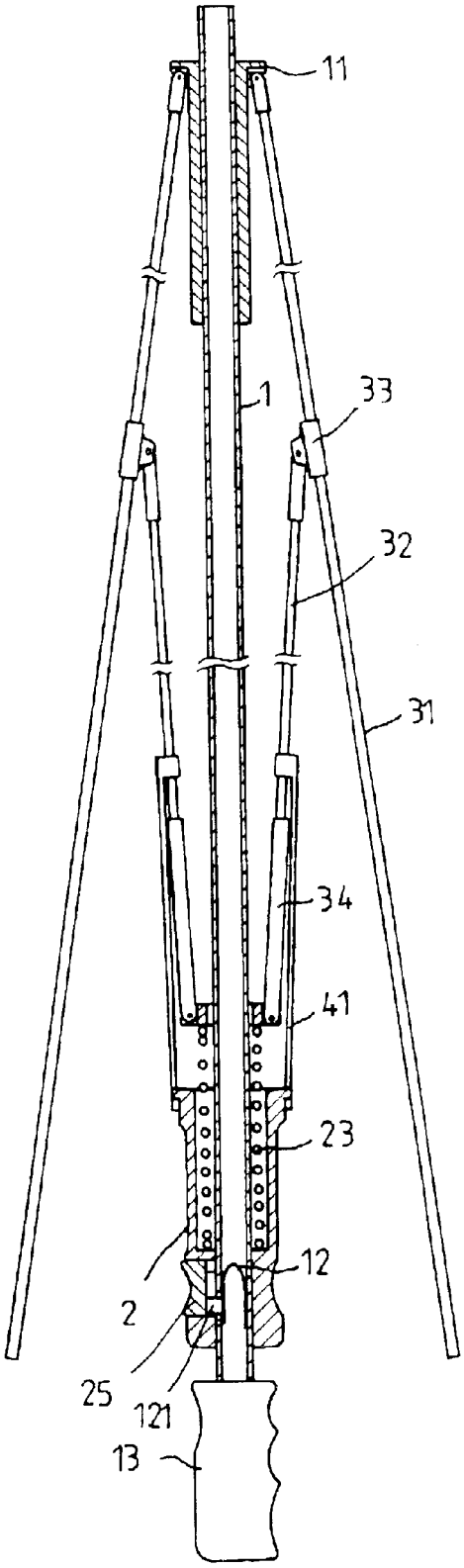
FIG. 3 is a plan view of FIG. 2 in closed state.
Figure 4:
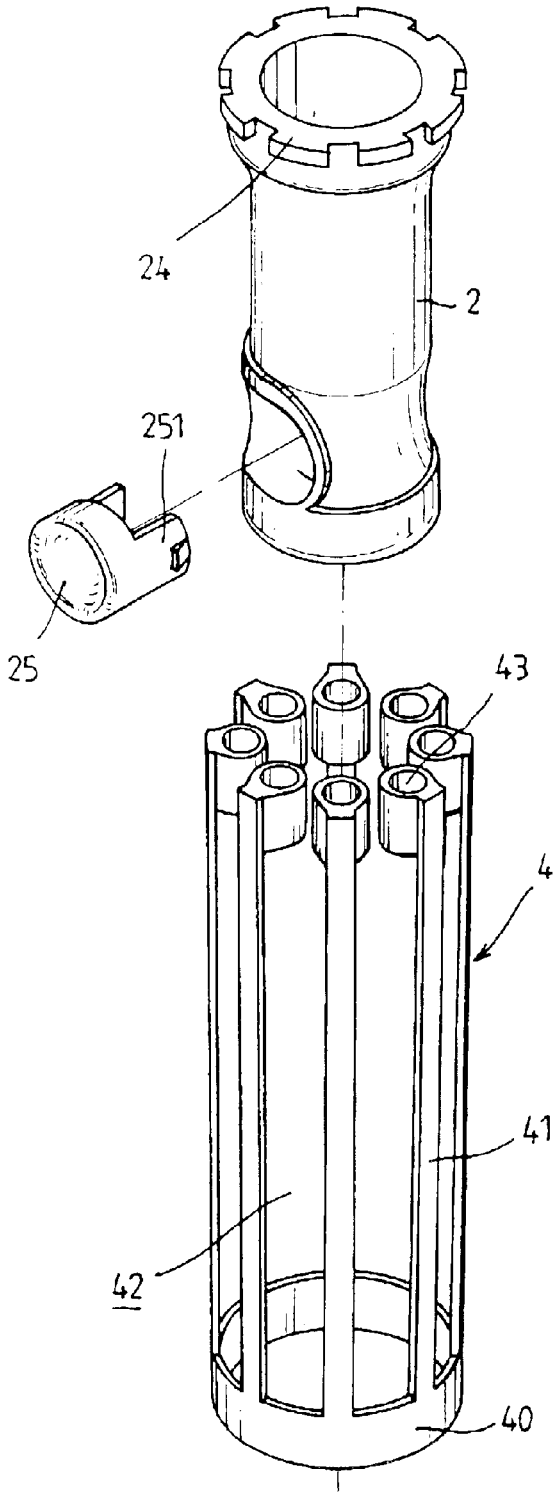
FIG. 4 is an exploded perspective view showing a plastic elastic frame and the runner according the present invention.
Figure 5:
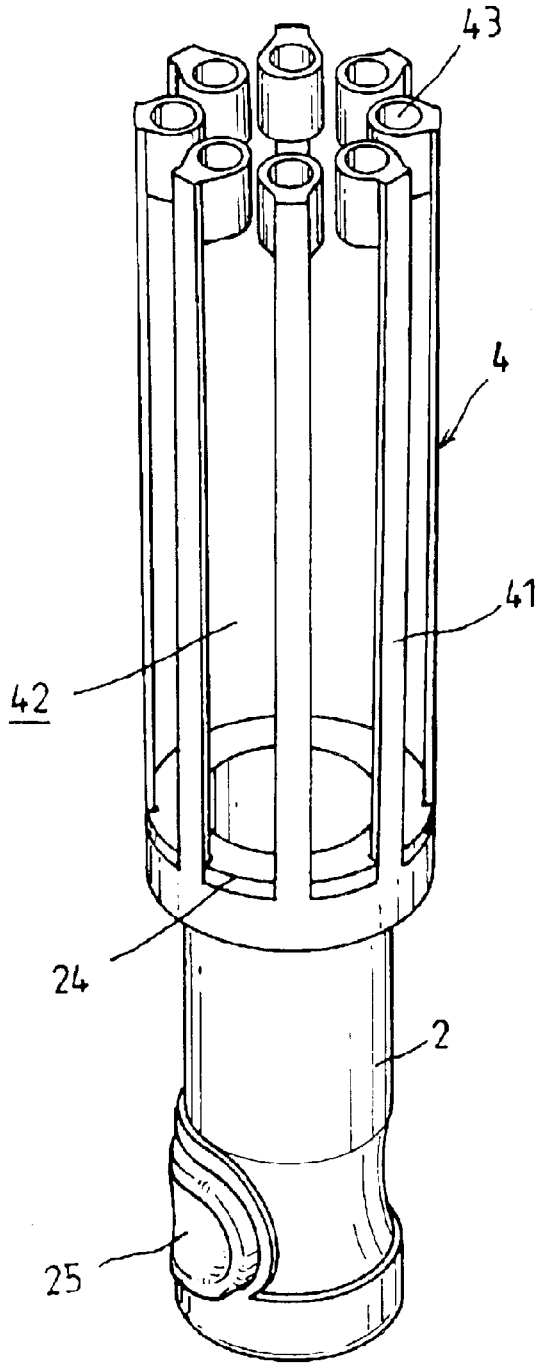
FIG. 5 is an assembled view of FIG. 4.

In FIG. 3, the umbrella is closed when a convex (121) of the U-shape spring (12) is engaged with the runner (2). To open the umbrella, it is very easy by pressing the button (25) to push the convex (121) moved inward. The runner (2) is then moved upward by the force of the coil spring (23). At this time, the second rib (32) is also moved outward to push the main rib (31) expanding, while the elastic rib (41) is bended and inclined, and the umbrella is opened automatically.

Figure 7:
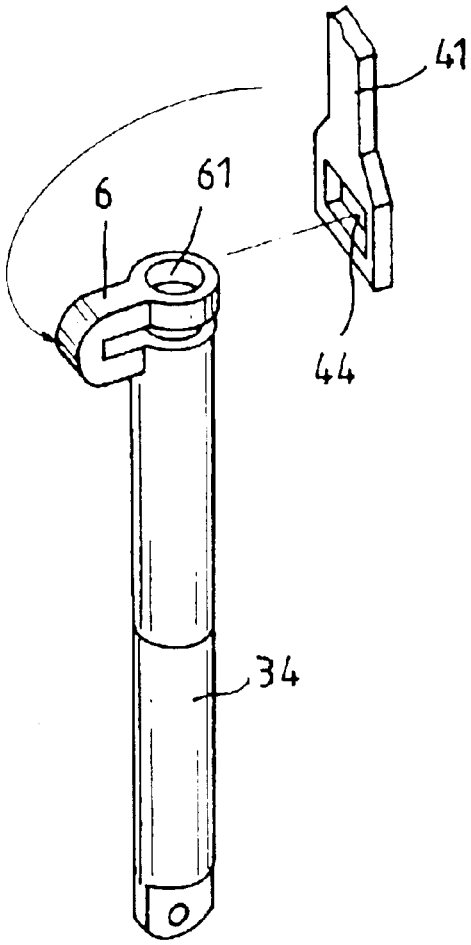
FIG. 7 is a perspective view of FIG. 7 showing the assembling procedure.
Figure 6:
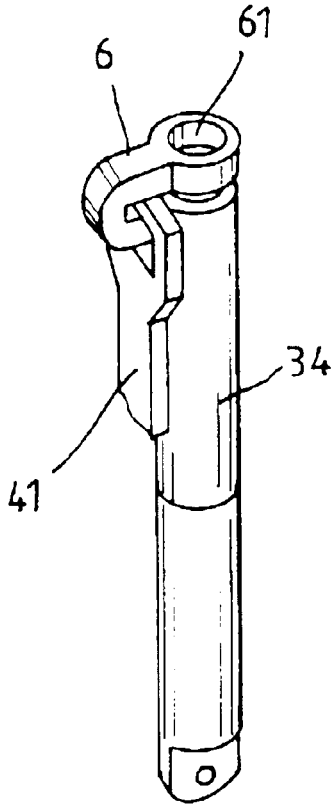
FIG. 6 shows a perspective view of a modified embodiment of the elastic frame and a tube connecting with the second rib.
Figure 10:
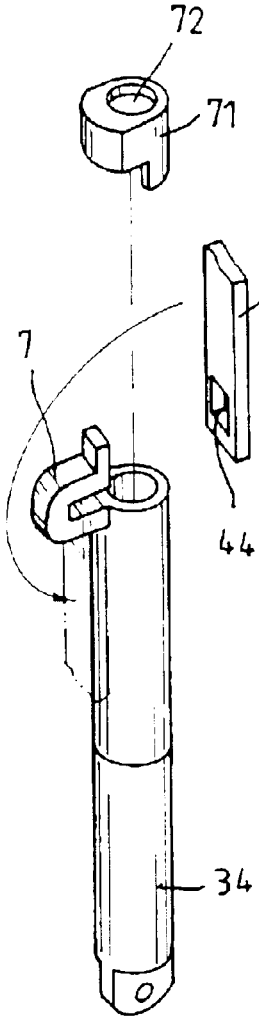
FIGS. 9 and 10 are views of FIG. 8 showing the assembling procedure.
Figure 9:
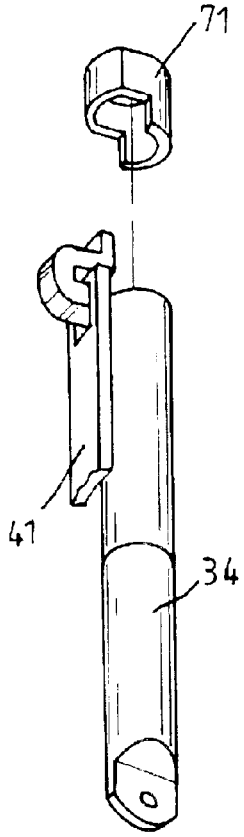
Figure 8:
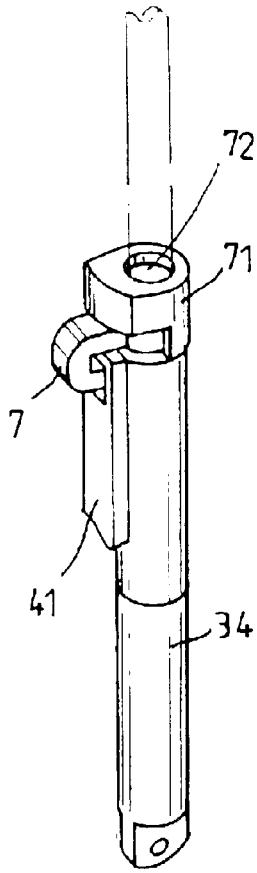
FIG. 8 shows a perspective view of another modified embodiment of the elastic frame and a tube connecting with the second rib.

Accordingly, the present invention obtains utility for use and should be allowed for patent. The above description is only an example of an embodiment and it can be modified under the same spirit of the invention and will be still claimed. Such as in FIGS. 6 and 7, they show a modified embodiment of the elastic branch rib (41) and the tube (34), wherein a connecting ring (6) is mounted on the tube (34) and a slot (44) on the branch rib (41). The connecting ring (6) passes through the slot (44) and the elastic branch rib (41) is connected with the tube (34). The connecting ring (6) has an aperture (61), which permits the second rib (32) received there through. In FIG. 8 to 10, they show another modified embodiment, which includes a connecting piece (7) formed on the tube (34) and engaged with the slot (44) of the branch rib (41). A cap (71) covers thereon and has an aperture (72) to receive the second rib (32).

What is claimed is:

1. An automatic umbrella including a shaft and a runner connecting with a frame having main ribs and second ribs, the inner end of the main rib being connected with an upper joint on the shaft, the second rib connected between a middle joint and the main rib, a U-shape spring being received in the shaft and a handle being connected with a lower end of the shaft; and the characteristic is to provide a plastic elastic frame connected between the runner and the second rib, the plastic elastic frame includes a ring-base and several parallel elastic branch ribs with several gaps being formed in a same interval between adjacent elastic branch ribs, each elastic branch rib has a hole at its top end to receive the second rib while each second rib connects with a tube at an inner end of the second rib and the diameter of the tube is larger than the hole of the elastic branch rib; the runner provided with an inner coil spring extending between the middle joint and the runner, the runner having several engaging projections in interval at its top end, while connecting the runner and the elastic frame, each engaging projection of the runner is inserted into and engaged with a related gap between two adjacent elastic branch ribs to retain the base-ring with the runner and assemble the runner and the elastic frame becoming a single body firmly.

2. The automatic umbrella as claimed in claim 1, wherein a button provided at lower side of the runner has two engaging slices.

3. The automatic umbrella as claimed in claim 1, wherein the second rib is made of plastic material.

4. The automatic umbrella as claimed in claim 1, wherein the runner and the elastic frame can be manufactured to be a single piece.

* * * * *